United States Patent [19]

Keefe et al.

[11] 4,333,690

[45] Jun. 8, 1982

[54] SLIDE MECHANISM

[75] Inventors: Tom Keefe, Stony Point; Bruno Rosellini, Orangeburg, both of N.Y.

[73] Assignee: Grant Industries Incorporated, West Nyack, N.Y.

[21] Appl. No.: 224,632

[22] Filed: Jan. 12, 1981

[51] Int. Cl.[3] ..... F16C 29/10

[52] U.S. Cl. ..... 308/3.8; 308/3.6

[58] Field of Search ..... 308/3.8, 3.6, 6 R, 3 R, 308/3 A; 312/350

[56] References Cited

U.S. PATENT DOCUMENTS

| | | | |
|---|---|---|---|
| 3,995,927 | 12/1976 | Stein | 308/3.8 |
| 4,101,178 | 7/1978 | Adams et al. | 308/3.6 |
| 4,119,377 | 10/1978 | Barber et al. | 308/3.6 |
| 4,227,750 | 10/1980 | Röck et al. | 308/3.8 |

*Primary Examiner*—Lenard A. Footland

*Attorney, Agent, or Firm*—Howard C. Miskin

[57] ABSTRACT

A slide structure for drawers, racks and the like includes a channel shaped first slide member secured to a support or supported by an exterior slide member slidably telescoped by the first slide member and a wheel carrying second slide member slidably telescoping the first slide member and having a longitudinal well in its inside face is secured to the drawer or rack. A pair of longitudinally spaced stop arms are pivoted at their outer ends to the well base and project toward each other and are outwardly biased by leaf springs projecting outwardly from the arm free ends and defining cams. When the drawer is pulled to a predetermined position extending the slides one of the arm end faces releasably engages an end stop face of the first slide member and the other arm end face engages a transverse stop face of the border of an opening in the first slide member to releasably lock the tracks in position. The leaf spring cam faces prevent excessive pivoting of the arms and jamming upon sliding of the slide members by depressing the excessively raised arms consequent to the engagement of a cam surface by a respective stop face.

10 Claims, 8 Drawing Figures

SLIDE MECHANISM

BACKGROUND OF THE INVENTION

The present invention relates generally to improvements in slide devices of the type employed in slidably supporting drawers in file cabinets and the like, electronic and other equipment on racks and other such structures and it relates more particularly to an improved slide assembly which may be releasably locked in an extended position.

In many types of storage and support structures such as file cabinets electronic equipment racks and the like, drawers mounting brackets and such are slidably mounted to permit their movement between retracted and advanced positions and to this end the drawers or brackets are supported in a cabinet or rack by means of longitudinal slide assemblies of various constructions. It is highly desirable with such structures that the drawer or brackets be capable not only of complete withdrawal but should be normally limited to withdrawably to a predetermined extended position and be releasably locked in such extended position. A mechanism for achieving such function should be highly reliable and jam proof, rugged easy and convenient to operate, of minimal cost and of great versitility and adaptability.

SUMMARY OF THE INVENTION

It is accordingly a principal object of the present invention to provide an improved slide structure for slidably supporting drawers in file and similar cabinets electronic carrying brackets in racks and similar assemblies.

Another object of the present invention is to provide an improved slide structure which may be releasably locked in an extended position.

Still another object of the present invention is to provide an improved slide structure which may be locked in an extended position and may be easily and conveniently released for further extension and separation or for movement to a contracted position and in which coupling and uncoupling of the slide members are simply accomplished.

A further object of the present invention is to provide a slide structure of the above nature characterized by its high reliability and its being rugged and jam-proof, simple to operate and manipulate and of great versitility and adaptability.

The above and other objects of the present invention will become apparent from a reading of the following description taken in conjunction with the accompanying drawings which illustrate a preferred embodiment thereof.

A slide structure in accordance with the present invention comprises a pair of first and second or more longitudinally slidable coupled slide members, the first member having a first stop, and a stop member having a second stop mounted on the second slide member and transversely movable between retracted and advanced positions with the second stop being out of and in the longitudinal path of the first stop and being spring biased to its advanced position, the stop member having a cam movable into engagement with the first stop which upon movement of the stop member toward the first stop acts on the cam to depress it and the stop member to a position in which the first and second stops are longitudinally aligned.

In accordance with a preferred form of the slide structure the first slide member is channel shaped and mounted to a support structure or other slide member and the second slide member slidably telescopes the first slide member and is secured to a drawer, brackets or other slidably supported device. The outer or rear end of the first slide member defines the first slide stop and an opening is formed in the rear portion of the first slide member cross web and its rear edge defines a third stop which is longitudinally and transversely offset from the first stop. A pair of first and second stop members are located on the second slide member at transversely and longitudinally spaced points and each includes and arm pivoted to the second slide member and having a free end defining respectively the second and a fourth stop which are swingable between retracted and advanced positions out of and in longitudinal registry with the first and second stops respectively. A bowed leaf spring projects outwardly from the under face of the free end of each arm, biasing the arm outwardly and defining a cam. As stop face of the first or second raised arm approaches a first or third stop, the first or second stop engages a respective spring cam surface to depress the corresponding arm and bring the arm end face into confronting alignment with an opposing first or third stop. Thus jamming is prevented and the slide members are locked in extended position by engagement of the first and third stops by the second and fourth stops and release is effected by depressing either of the arms depending on whether the slide members are to be extended or contracted.

The improved slide structure is highly rugged and jam-proof simple to assemble, disassemble and operate and is of great versatility and adaptability.

DESCRIPTION OF THE PREFERRED EMBODIMENT

Figure 1:
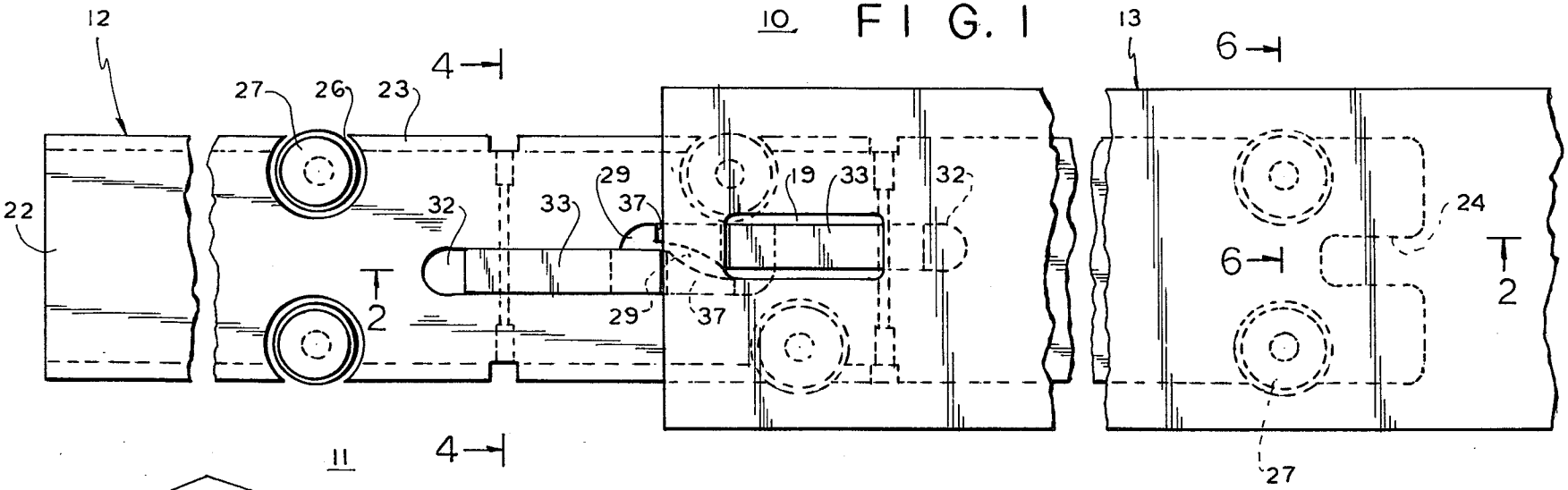
FIG. 1 is a front elevational view, partially broken away, of a slide assembly embodying the present invention and shown in a locked extended position.

Referring now to the drawings which illustrate a preferred embodiment of the present invention the reference numeral 10 generally designates the improved slide assembly which is illustrated as applied by way of example, to a multi-drawer file or storage cabinet 11, it being understood that it may be applied to other drawer, bracket and shelf structures, such as racks for electronic equipment and the like. The assembly 10, a pair of which is employed with each drawer includes longitudinally slidably intercoupled inner and outer longitudinal slide members 12 and 13 respectively. The cabinet 11 includes an outer case 14 open at its front and having vertical side walls 16 and a plurality of vertically spaced drawers 17 each of which is supported by a pair of slide assemblies 10 for slidable movement between advanced extracted and retracted positions in case 14, the assemblies 10 permitting to full withdrawal and insertion of a drawer 17 and the automatic releasable stopping and locking thereof in a predetermined extended position as will be hereinafter explained.

The outer slide member 13 is channel shaped and includes a vertical cross-web 18 having formed therein shortly inwardly of one end thereof a longitudinally elongated rectangular opening 19 which is slightly offset from the medial longitudinal axis of web 18 and having formed at its opposite end edge a rectangular medially positioned notch and a medially located stop defining medial projection inwardly of the notch (not shown). Extending along opposite longitudinal edges of cross web 18 and integrally formed therewith are parallel track members 20 provided along their confronting faces with longitudinal guide grooves 21.

The inner slide member 12 comprises a longitudinal plate 22 provided along the inside faces of the opposite longitudinal edges thereof with longitudinal flanges 23 which register with grooves 21. The outside face of plate 22 is coplanar with corresponding faces of tracks 20, and plate 22 has formed in one of its outer ends a medial recess 24 in longitudinal alignment with the previously identified stop on web 18. A plurality of longitudinally spaced circular wells 26 open at their outer ends are formed along the outer longitudinal borders of the inside face of plate 22. Nesting in each of the wells 26 and rotatably supported by plate 22 is a bearing mounted roller 27 whose outer periphery projects beyond the corresponding flange 23 and slidably engages a respective track groove 21 so that the inner and outer slide members 12 and 13 are relatively freely slidable.

Medially formed in the inside face of plate 22 between the ends thereof is a rectangular well 29 having circular openings 30 formed in a pair of diagonally opposite corners of the base of well 29. Extending longitudinally from the aperatured diagonally opposite corners of well 29 are a pair of oppositely directed transversely offset longitudinally elongated wells 32 whose bases are coplanar with that of well 29.

A stop member 33 of the shape of an elongated rectangular bar is located in each of the wells and extends into well 29, and is pivoted at its inner end between the opposing faces of the corresponding well 32 proximate their outer ends by a pin 34 engaging aligned bores in stop member 33 and the opposite walls of well 32. Each stop member 33 is thus swingable about a transverse axis between a retracted position nested in a well 32 and an advanced position projecting above well 32, the upwarding swing of stop member 33 being limited by the leveled face 36 at the bottom inner corner of the stop member. In the retracted position stop member 33 its inner end extends into well 29 and overlies an opening 30.

Achieved to the free end of each stop member 33 is an upwardly bowed resilient steel leaf spring 37 having an enlarged base end 38 and a reverse curved downwardly convex foot end 39. Leaf spring 37 projects outwardly and downwardly from stop member 33 and has a longitudinally extending linear outer edge 40 extending along an adjacent longitudinal face of well 29 and an oblique or concave inner edge 41 converging toward edge 40 approaching the free end of leaf spring 37 so that the leaf springs 37 of opposite stop members 33 are transversely spaced in well 29 and the free ends of the transversely spaced stop members 33 are longitudinally separated in the stop member retracted positions. The base 38 of each leaf spring 37 underlies the underface of the free end of a corresponding stop member 33 and is secured thereto by a rivet 42 whose upper end nests in a recess in the stop member top face and whose lower end terminates in an enlarged head 43. The inner section 44 of each leaf spring top face defines a cam which extends downwardly outwardly and the foot pieces 39 rest on the base of well 29 to resiliently upwardly bias stop members 33. When the stop members 33 are in their retracted positions in wells 29 and 32 the rivet heads 43 engage respective openings 30 and the top faces of stop members 33 are about coplanar with the top face of plate 22.

Figure 2:
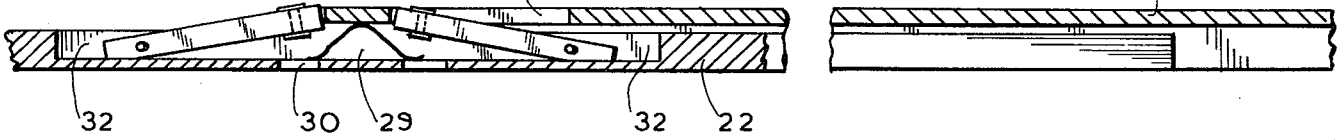
FIG. 2 is a sectional view taken along line 2—2 in FIG. 1.
Figure 3:
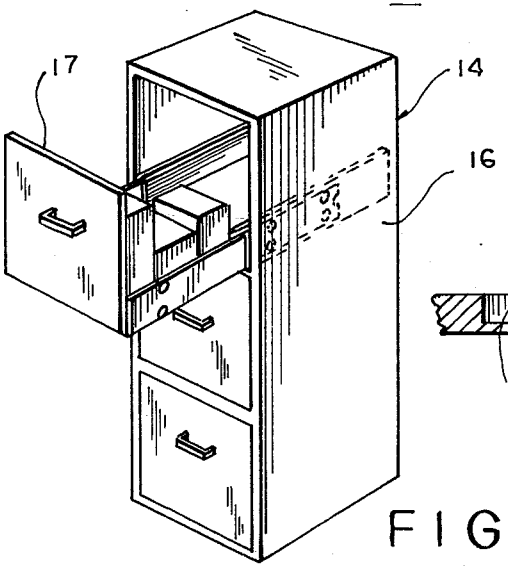
FIG. 3 is a perspective view of a file cabinet employing the slide assembly of FIG. 1 and shown with a slide drawer partially withdrawn.

In the operation of the improved slide assembly, when slide members 12 and 13 are in their relatively extended position as shown in FIGS. 1 and 2, slide member 12 projects beyond slide member 13 and the stop members are raised to their advanced positions by leaf springs 37, the free end face of outer stop member 33 engaging the adjacent end edge of the cross web 18 of slide member 13 to prevent contraction of the slide members and the free end face of the inner stop member 33 engages the adjacent transverse edge of opening 19 in cross web 18 to prevent further relative extension of the slide members to thereby lock the slide members in a predetermined extended position. In order to contract the slide members the outer stop member 33 is manually depressed to lower the free end face thereof below the level of the free end of cross web 18 and the slide members then contracted, the inner transverse edge of cross web 18 depressing the inclined inner stop member 33 with the slide member contraction to permit such contraction. Similarly to permit further extension of the extended slide members, the inner stop member 33 is manually depressed below the level of web 18 and the slide members extended or disconnected as desired.

When the contracted slide members are relatively extended, as the outer stop member 33 traverses the vicinity of opening 19 it is retained in its retracted position by the web 18 longitudinally bordering opening 19 since outer stop member 33 is transversely offset from opening 19 and as the free end face of outer stop member 33 passes the end edge of web 18 it advances under the influence of a spring 37 into engagement with such end edge. Concurrently, the inner stop member moves into registry with opening 19 and is raised by a spring 37 to bring its free end face into engagement with the front transverse edge of opening 19 to releasably lock the slide members in an extended position.

Figures 4, 5, 6, 7, 8:
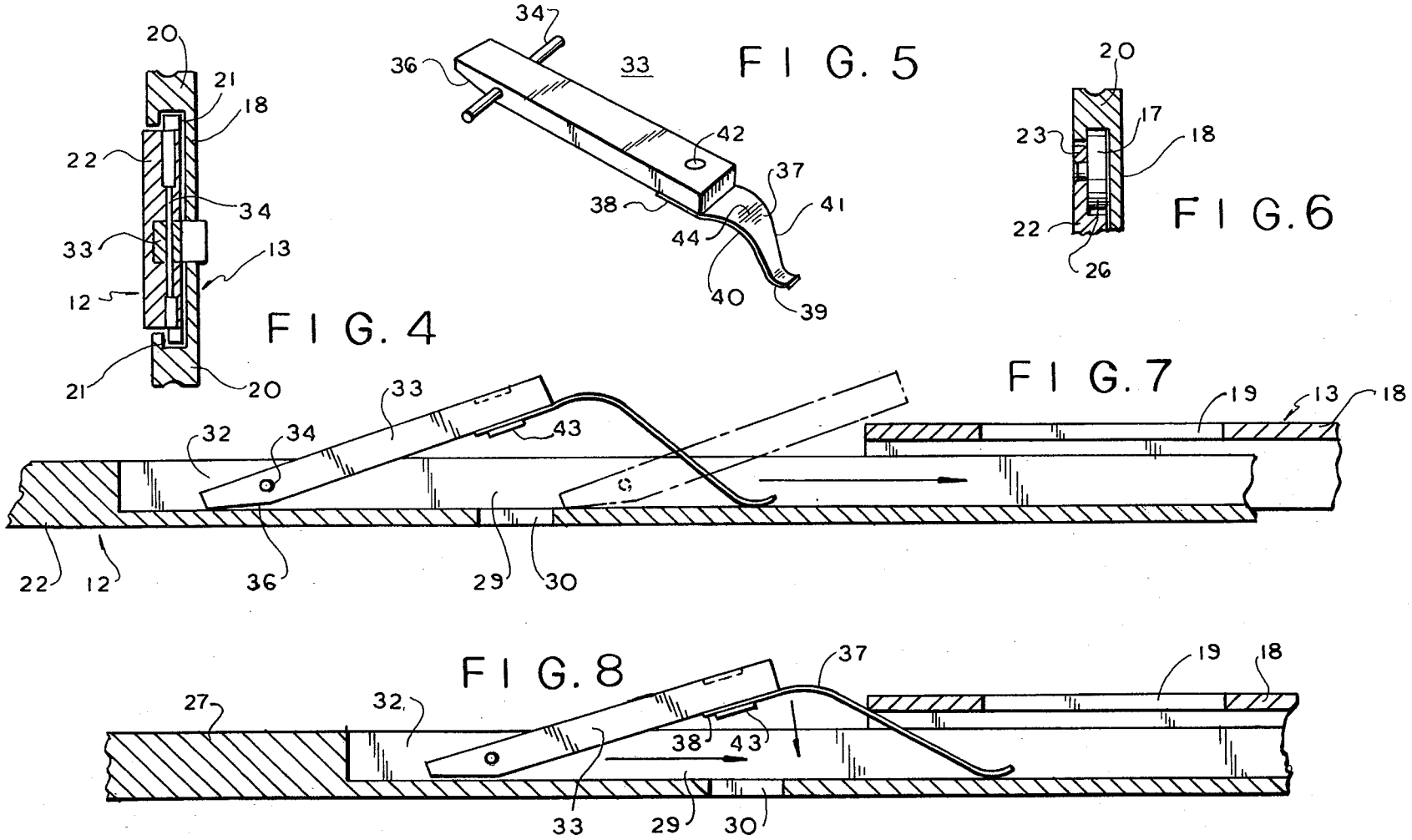
FIG. 4 is a sectional view taken along line 4—4 in FIG. 1.
FIG. 5 is a front perspective view of a stop member component of the slide assembly of FIG. 1.
FIG. 6 is a sectional view taken along line 6—6 in FIG. 1.
FIG. 7 is an enlarged sectional view similar to FIG. 2 showing the slide members extended beyond the position shown in FIGS. 1 and 2 and showing by broken line the jamming of a stop member when not constructed in accordance with the present invention.
FIG. 8 is a view similar to FIG. 7 showing the slide members contracted from the position illustrated in FIG. 7.

It is important to note that, as best seen in FIGS. 7 and 8 the free end face of a stop member 33 approaches the confronting stop defined by the adjacent end edge of cross web 18 or the adjacent transverse edge of opening 19, a respective stop defining edge engages the cam defining top face of a corresponding leaf spring 37 to depress the spring 37 and the supporting member 33. This action assumes that the stop member end face does not raise above the level of the web 18 in the manner illustrated by broken line in FIG. 7. Should this latter occur, jamming and damage to the slide mechanism would probably result since with further relative movement of the slide members the stop member would be forcibly wedged upwardly and distant or break the slide mechanism components.

While there has been described and illustrated a preferred embodiment of the present invention it is apparent that numerous alterations, omissions and additions may be made without departing from the spirit thereof. For example, the forwardmost stop arm may be eliminated whereby the other stop arm and the window serve as a stop and further extension or disconnect function. When extending the inner slide member in this case, it advances until the stop arm 33 engages the stop defining edge of window 19 and then stops. By depressing stop arm 33 the inner member can be further extended and completely removed or disconnected from the assembly. Moreover, while in the described embodiment one of the pairs of cooperating slide members is directly secured to a stationary support it may be slidably coupled to a third slide member which may be in turn directly secured to the support or connected to the support by way of one or more additional slide members to permit greater of the slide assembly.

We claim:

1. A slide structure comprising a pair of first and second longitudinal slide members mutually relatively longitudinally slidable between relatively extended and contracted positions, said first slide member having a first stop defining face and a first stop member located on and longitudinally movable with said second slide member and transversely movable between an inwardly retracted position toward said second slide member out of the relative path of movement of said first stop and an advanced position at least in said path of movement and being spring biased to an advanced position and including a second stop defining face facing toward said first stop and a cam surface extending from said second stop toward said first stop and inwardly inclined toward said first stop whereby with relative longitudinal movement of said slide members said first stop engages said cam surface to retract said stop member to a position with said second stop in said first stop relative path of movement.

2. The slide structure of claim 1 wherein said first stop and second stops are defined by rearwardly and forwardly facing faces respectively and are in mutual engagement at a predetermined extended position of said slide members to releasably lock said slide members against contraction.

3. The slide structure of claim 2 wherein said secured slide member includes a third stop defining face facing oppositely of said first stop defining face and further comprising a second stop member located on and longitudinally movable with said second slide member and transversely movable between an inwardly retracted position toward said second slide member out of the relative path of movement of said third stop and an advanced position at least in said path of movement of said third stop and being spring biased to an advanced position and including a fourth stop defining face facing toward said third stop and a cam surface extending from said fourth stop toward said third stop and inwardly inclined toward said third stop whereby with relative longitudinal movement of said slide members said third stop engages said cam surface to retract said fourth stop member to a position with said fourth stop in said third stop relative path of movement.

4. The slide structure of claim 3 wherein said third and fourth stops are defined by forwardly and rearwardly faces respectively and are in mutual engagement at a predetermined position of said slide members to releasably lock said slide members against further extension.

5. The slide structure of claim 1 wherein said first stop and second stops are defined by forwardly and rearwardly facing faces respectively and are in mutual engagement at a predetermined extended position of said slide members to releasably lock said slide members against further extension.

6. The slide structure of claim 1 wherein said stop member includes an arm pivotally connected proximate a first end thereof to said second slide member and having face at its opposite end defining said second stop, said arm being swingable between a predetermined raised projecting advanced position and a retracted position substantially along said arm.

7. The slide structure of claim 6 wherein said stop member includes a leaf spring having one end secured to said arm opposite end and projecting outwardly and toward the level of the retracted position of said outer end, a face of said spring defining said cam surface.

8. The slide structure of claim 7 wherein said leaf spring is bowed in a direction opposite said retracted position level.

9. The slide structure of claim 6 wherein said first slide member is channel shaped and includes a cross web and top and bottom tracks and said second slide member slidably telescopes said first slide member and has a well formed in its face confronting said cross web, said arm in its retracted position being disposed in said well.

10. The slide structure of claim 9 wherein said stop member has a face engaging the base of said well when said arm is in its fully advanced position.

* * * * *